US010400637B2

(12) United States Patent
Hubmann et al.

(10) Patent No.: US 10,400,637 B2
(45) Date of Patent: Sep. 3, 2019

(54) VARIABLE VALVE CONTROL DEVICE FOR INTERNAL COMBUSTION ENGINES

(71) Applicant: AVL LIST GMBH, Graz (AT)

(72) Inventors: Christian Hubmann, Graz (AT); Helmut Melde-Tuczai, Graz (AT)

(73) Assignee: AVL LIST GMBH, Graz (AT)

( * ) Notice: Subject to any disclaimer, the term of this patent is extended or adjusted under 35 U.S.C. 154(b) by 0 days.

(21) Appl. No.: 15/760,103

(22) PCT Filed: Sep. 19, 2016

(86) PCT No.: PCT/AT2016/060066
§ 371 (c)(1),
(2) Date: Mar. 16, 2018

(87) PCT Pub. No.: WO2017/045009
PCT Pub. Date: Mar. 23, 2017

(65) Prior Publication Data

US 2019/0048760 A1 Feb. 14, 2019

(30) Foreign Application Priority Data

Sep. 18, 2015 (AT) ..... 50801/2015

(51) Int. Cl.
*F01L 1/047* (2006.01)
*F01L 13/00* (2006.01)

(52) U.S. Cl.
CPC ..... *F01L 1/047* (2013.01); *F01L 13/0036* (2013.01); *F01L 2001/0473* (2013.01); *F01L 2013/0052* (2013.01)

(58) Field of Classification Search
CPC ..... F01L 2001/0473; F01L 1/053; F01L 1/46; F01L 13/0036; F01L 2013/0052; F01L 2105/00
(Continued)

(56) References Cited

U.S. PATENT DOCUMENTS

2016/0084368 A1* 3/2016 Meusel ..... F01L 13/0036 74/567

FOREIGN PATENT DOCUMENTS

DE 19520117 5/1996
DE 19908286 8/2000
(Continued)

OTHER PUBLICATIONS

English Abstract of DE 19520117.
(Continued)

*Primary Examiner* — Jorge L Leon, Jr.
(74) *Attorney, Agent, or Firm* — Dykema Gossett PLLC

(57) ABSTRACT

The invention relates to a variable valve control device (1) for internal combustion engines of the reciprocating-piston design having at least one gas exchange valve, which can be actuated by a camshaft (3) by means of a cam device (4) that is connected to the camshaft (3) for conjoint rotation and that has at least two different cam tracks (7, 8), which camshaft is supported in such a way that the camshaft can be rotated about a camshaft axis (2), wherein, selectively, one of the cam tracks (7, 8) can be activated and at least one other cam track (8, 7) can be deactivated by means of a control device (10), and wherein the control device (10) has at least one control element (11), which is guided axially, in particular within the camshaft, and by which at least one cam device (4) that is supported on the camshaft (3) for conjoint rotation but axially movably and that has at least two different cam tracks (7, 8) can be adjusted by means of at least one driving piece (12). In order to enable reliable and fail-safe variable valve actuation in the simplest possible manner, at least one blocking element (20) is provided for blocking and releasing the axial adjustment motion of the cam device (4), wherein the blocking element (20) has a control stud (21) fixedly connected to the cam device (4) and a—preferably station-
(Continued)

ary—control disk (22) arranged coaxial to the camshaft (3), wherein the control disk (22) has, in at least one angular region, at least one control opening (25) for receiving the control stud (21).

16 Claims, 4 Drawing Sheets

(58) Field of Classification Search
USPC ..... 123/90.18, 90.27
See application file for complete search history.

(56) References Cited

FOREIGN PATENT DOCUMENTS

| | | |
|---|---|---|
| DE | 102011085702 | 5/2013 |
| DE | 102011085706 | 5/2013 |
| JP | S61201804 | 6/1986 |
| JP | 2011226422 | 11/2011 |

OTHER PUBLICATIONS

English Abstract of DE 19908286.
English Abstract of DE 102011085702.
English Abstract of DE 102011085706.
English Abstract of JPS61201804.
English Abstract of JP2011226422.

* cited by examiner

VARIABLE VALVE CONTROL DEVICE FOR INTERNAL COMBUSTION ENGINES

BACKGROUND OF THE INVENTION

Field of the Invention

The invention relates to a variable valve control device for internal combustion engines of the reciprocating piston type comprising at least one gas exchange valve, which is actuable by means of a camshaft, which is mounted so it is rotatable about a camshaft axis, via a cam device, which is connected to the camshaft in a rotationally-fixed manner and has at least two different cam tracks, wherein alternately one of the cam tracks is activatable and at least one other cam track is deactivatable by means of a control device, and wherein the control device has at least one positioning element, which is axially guided inside the camshaft in particular, and by which by means of at least one driver part, at least one cam device, which is mounted in a rotationally-fixed but axially displaceable manner on the camshaft and has at least two different cam tracks, is adjustable.

The Prior Art

A valve drive of an internal combustion engine is known from DE 109 520 117 A1, in which a cam having different cam tracks is pivoted by a camshaft. The cam can be displaced axially on the camshaft in this case to implement different valve lifts. The adjustment element required for the displacement is arranged in the interior of the camshaft. The movement of the adjustment element is transmitted via a spring element, which is also guided in the interior of the camshaft, to the axially displaceable cam. Since the axial displacement of the cam is possible in practically any rotational angle position of the camshaft, damage to the cam tracks or transmission devices cannot be precluded.

DE 199 08 286 A1 describes a variable valve control device for internal combustion engines, which comprises valves for gas exchange control, which are actuated by means of a camshaft. The camshaft has a positioner shaft comprising an actuating device and relatively movable cam devices. Each cam device is mounted so it is axially movable on the column shaft. A spring device is provided between the cam device and the positioner shaft, which attempts to move the cam device into the base position. The cam device cooperates with a trigger device, which is provided with a control ring attached fixedly on the positioner shaft and a locking pin arranged radially to the positioner shaft. The control ring has a control cam, and the locking pin, which is operationally connected to a compression spring, has a control projection. The control cam engages below the control projection depending on an axial position and a radial position of the positioner shaft and raises the locking pin after a partial rotation of the positioner shaft, whereby the cam device executes an axial movement into a defined operating position. In this case, the spring device holds the cam device in a base position, from which the positioner shaft moves this cam device as a function of parameters of the internal combustion engine into a defined operating position. The trigger device, which ensures a functional movement of the cam device, only becomes active when the positioner shaft is located in defined positioning positions. It is disadvantageous that an additional control effort is necessary for the actuation of the trigger device.

The object of the invention is to avoid the mentioned disadvantages and to enable a reliable and failsafe variable valve actuation in the simplest possible manner.

SUMMARY OF THE INVENTION

This is achieved according to the invention in that at least one locking element is provided for locking or releasing, respectively, the axial adjustment movement of the cam device, wherein the locking element has a control stud fixedly connected to the cam device and a control plate arranged—preferably fixedly—coaxially to the camshaft, wherein the control plate has at least one control opening in at least one angle range for accommodating the control stud.

The control plate can be arranged fixed on the housing in this case. The locking or release, respectively, of the adjusted movement of the cam device takes place solely mechanically by the arrangement of the control opening on the control plate and the interaction of the control stud with the control opening. A complex controller can thus be omitted. The invention additionally has the advantage—in comparison to the prior art known from DE 199 08 286 A1—that parts and structural space can be saved.

The control stud is advantageously arranged radially protruding on the cam device, preferably on an outer casing of the cam device. The control stud is fixedly, i.e., non-displaceably, connected to the cam device, and is provided protruding radially outward on the outer casing of the cam device. The control stud can be pressed, adhesively bonded, or screwed into a radial borehole of the cam device in this case, for example.

In one preferred embodiment variant of the invention, it is provided that the control opening is arranged in a wall of the control plate facing toward the cam device, which is formed, for example, normal to the rotational axis of the camshaft. Simple manufacturing of the control opening is possible if it is embodied as a wall breakthrough.

The control opening can—observed in a frontal view—essentially have the shape of a circular segment or a circular ring segment, wherein it is particularly advantageous if the control opening extends over an angle range of at least 60°, preferably at least 90°. An unobstructed axial displacement of the control stud in the control opening is thus possible, without a collision of the control stud with the edge of the control plate occurring. Damage to control stud and the control plate can thus be prevented.

Furthermore, it is advantageous for an unobstructed axial displacement of the control stud if the wall of the control plate has a thickness which essentially corresponds to the thickness of the control stud—measured in the direction of the camshaft axis.

To enable an unobstructed rotation of the cam device, it is advantageous if the control plate is exposed on both sides of the wall. This prevents collisions of the control stud with adjoining elements.

To keep the wear of the valve control device low, it is advantageous if the control opening and the control stud are arranged in relation to one another in those angle ranges of the control plate and/or the camshaft such that the cam device is only adjustable in the valve-lift-free state, wherein preferably the base circles of the cam tracks face toward a lift transmission element.

During an adjustment of the camshaft from a first displacement position into a second displacement position, an adjustment force, for example, a spring force acts via the positioning element and the driver part on the cam device and therefore on the control stud in the direction of the control plate, whereby the control stud is pressed against the end face of the wall of the control plate. As long as the control stud presses against the wall of the control plate, an axial movement of the cam device is prevented. However, as soon as the control stud reaches the region of the control opening due to the camshaft rotation, it is pressed by the spring force acting on the cam device through the control opening of the control plate until the control stud has completely penetrated the control opening. This adjustment takes place best in a valve-lift-free state, i.e., when the base circles face toward a lift transmission element, for example, a valve lever or a valve tappet. The cam device is located after the adjustment in its second displacement position.

BRIEF DESCRIPTION OF THE DRAWINGS

The invention will be explained in greater detail hereafter on the basis of the nonrestrictive figures. In the figures.

DETAILED DESCRIPTION OF THE DEPICTED EMBODIMENT

Figure 1:
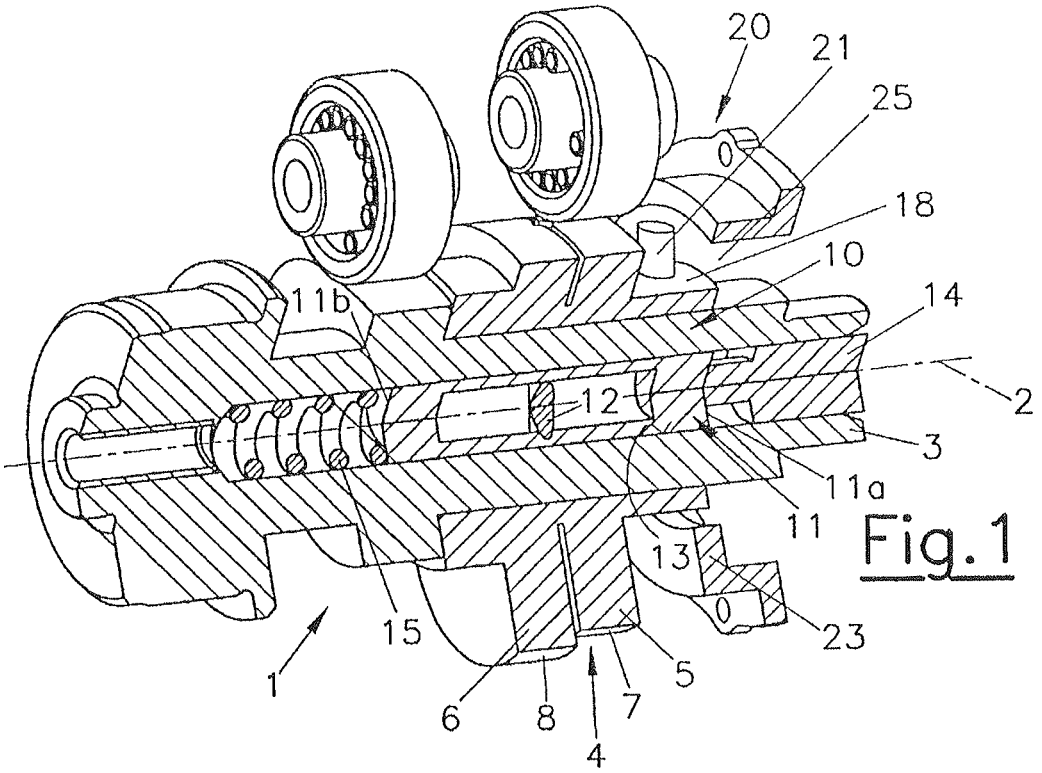
FIG. 1 shows a variable valve control device according to the invention in a diagonal view in a longitudinal section in a first displacement position.

The figures show a variable valve control device 1 for internal combustion engines having at least one camshaft 3 mounted so it is rotatable about a camshaft axis 2, wherein a cam device 4 having at least two cams 5, 6 and cam tracks 7, 8 is connected to the camshaft 3 so it is rotationally fixed but axially displaceable. The cam device 4 acts in the exemplary embodiment on a transmission element 30, embodied as a roller body, for example, of a lift transmission device 31—for example, a valve lever—which lift transmission device 31 actuates at least one gas exchange valve (not shown in greater detail in the figures) of the internal combustion engine.

One of the cam tracks 7, 8 can alternately be activated or deactivated via a control device 10.

The control device 10 has at least one positioning element 11 guided axially inside the camshaft 3, to which a driver part 12 formed by a radial stud is fixedly connected. The positioning element 11 is designed as a piston, which is guided so it is longitudinally displaceable in a guide cylinder 13, arranged coaxially to the camshaft axis 2, of the camshaft 3. An actuator 14 acts on a first end face 11*a* of the addition element 11, a restoring spring 15, which acts against the deflection of the actuator 14, acts on a second end face 11*b* of the positioning element 11. The driver part 12 penetrates, in the radial direction, an oblong hole 16 of the camshaft 3 and is embedded in a radially extending borehole 17 of the cam device 4. The cam device 4 is therefore connected via the driver part 12 to the positioning element 11, such that the axial displacement movement of the positioning element 11 between a first displacement position and a second displacement position is transmitted to the cam device 4. By displacing the cam device 4, alternately the first cam 5 or the second cam 6 of the cam device 4 can be activated, by engaging the first cam track 7 or the second cam track 8, respectively, with the transmission element 30 of the lift transmission device 31.

The displacement of the cam device 4 may be carried out with minimal application of force in the valve-lift-free state, i.e., when the base circles 7*a*, 8*a* of the cam tracks 7, 8 face toward the transmission element 30 of the lift transmission device 31.

Figure 9:
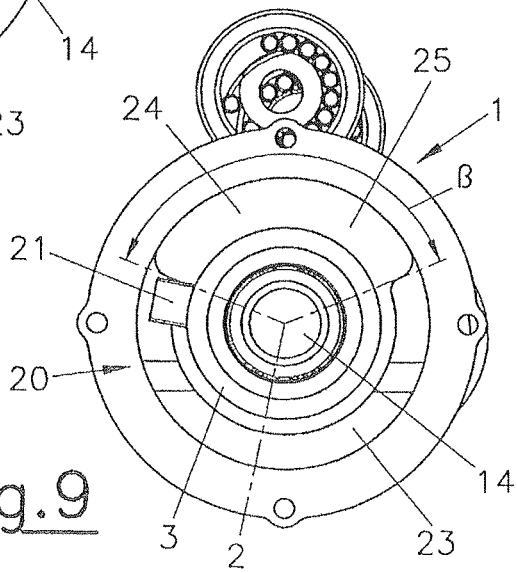
FIG. 9 shows the valve control device in a side view.

To be able to carry out the adjustment between the two cams 5, 6 only in a defined position of the camshaft 3, in particular in the valve-lift-free state, a locking element 20 is provided. The locking element 20 has a control stud 21 fixedly connected to the cam device 3 and a housing-fixed control plate 22 arranged coaxially to the camshaft 3. The control stud 21 is arranged protruding radially from a cylindrical outer casing 18 of the cam device 4. The control plate 22 has, on the side facing toward the cam device 4, a wall 23 arranged or extending normal to the camshaft axis 2, in which a wall breakthrough 24 is formed. The wall breakthrough 24, which is formed in the exemplary embodiment as a circular ring segment, forms a control opening 25 corresponding to the control stud 21 and extends over a defined angle range β about the camshaft axis 2, wherein in the exemplary embodiment the angle range β is approximately 130° (FIG. 9).

The control opening 25 and the control stud 21 are arranged in relation to one another in such angle ranges of the control plate 22 or the camshaft 3, respectively, that the cam device 4 is only adjustable in a valve-lift-free state, i.e., when the base circles 7*a*, 8*a* of the cam tracks 7, 8 face toward the lift transmission device 31.

The wall 23 has a thickness b, which essentially corresponds to the thickness d of the control stud 21—measured in the direction of the camshaft axis 2.

The control plate 22 is exposed on both sides of the wall 23, such that an unobstructed rotation of the control stud 21 about the camshaft axis 2 is possible.

Figure 2:
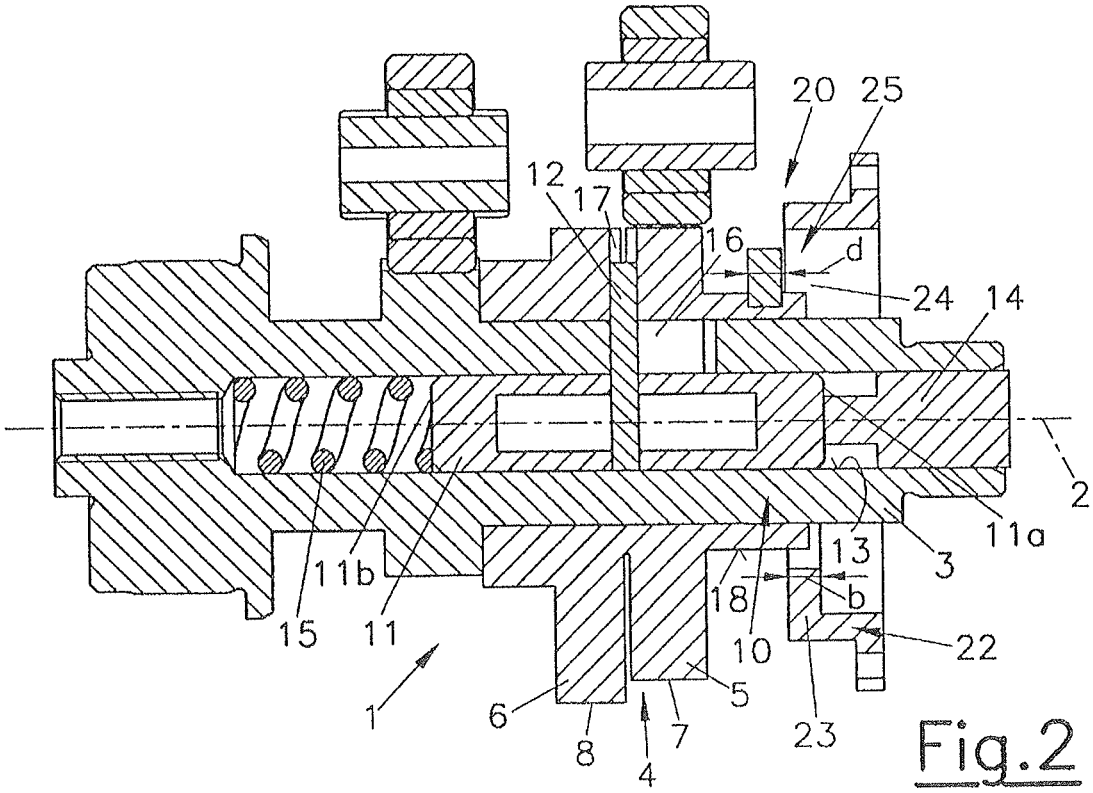
FIG. 2 shows the valve control device in a longitudinal section in the first displacement position.

FIG. 1 and FIG. 2 show the cam device 4 in a first displacement position, wherein the first cam 5 is activated using the first cam track 7. The positioning element 11 is pressed by the actuator 14 to the left in FIG. 1 and FIG. 2, i.e., in a direction leading away from the blocking element 20. In the illustrated location of the camshaft 3, the base circles 7*a*, 8*a* face toward the transmission element 30 of the lift transmission device. The control stud 21 is located in this case in the region of the control opening 25, such that the axial displacement movement of the cam device 4 is released by the locking element 20—corresponding to the activation of the actuator 14.

Figure 3:
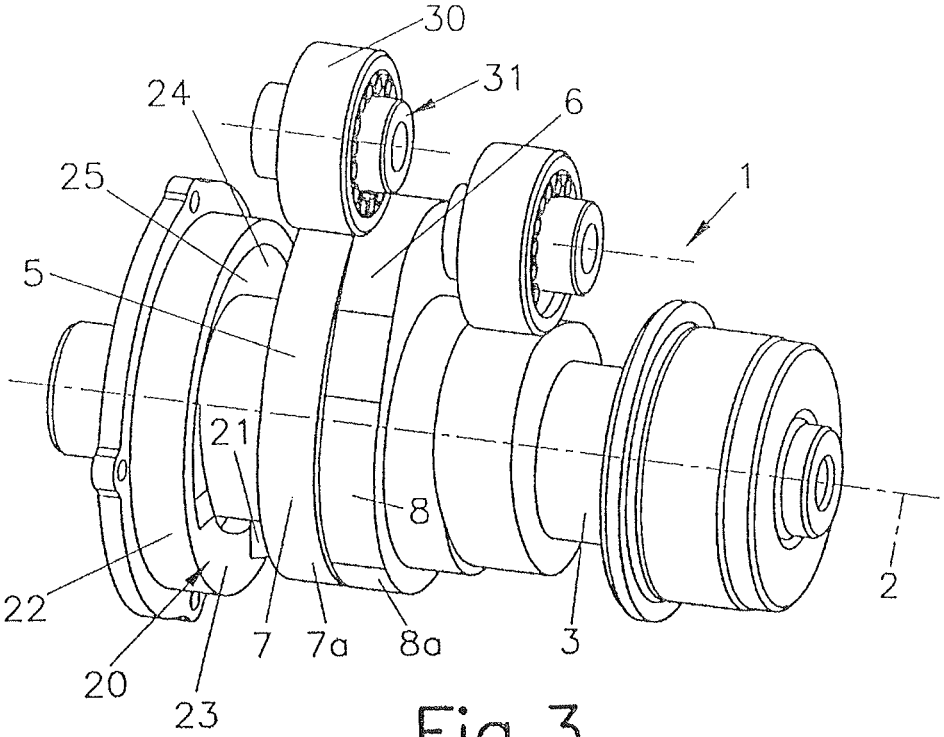
FIG. 3 shows the valve control device in another diagonal view in the first displacement position.
Figure 4:
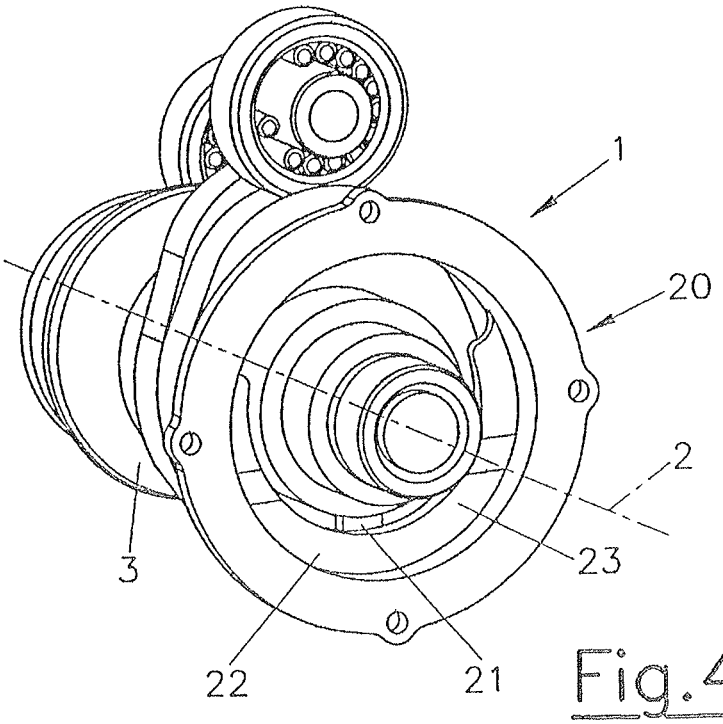
FIG. 4 shows the valve control device in a further diagonal view in the first displacement position.

FIG. 3 and FIG. 4 also show the cam device 4 in the first displacement position, wherein the first cam 5 is activated using the first cam track 7. However, the cam 5 is located here in its lift position—an axial adjustment of the cam device 4 would be undesirable here. The axial adjustment in this camshaft location is blocked by the locking element 20, by the control stud 21 traveling on the wall 23 of the control plate 22. It can be seen clearly in FIG. 3 and FIG. 4 that the control stud 21 is located in its lower position, which is diametrically opposite to the control opening 25 with respect to the camshaft axis 2, and therefore presses against the wall 23.

Figure 5:
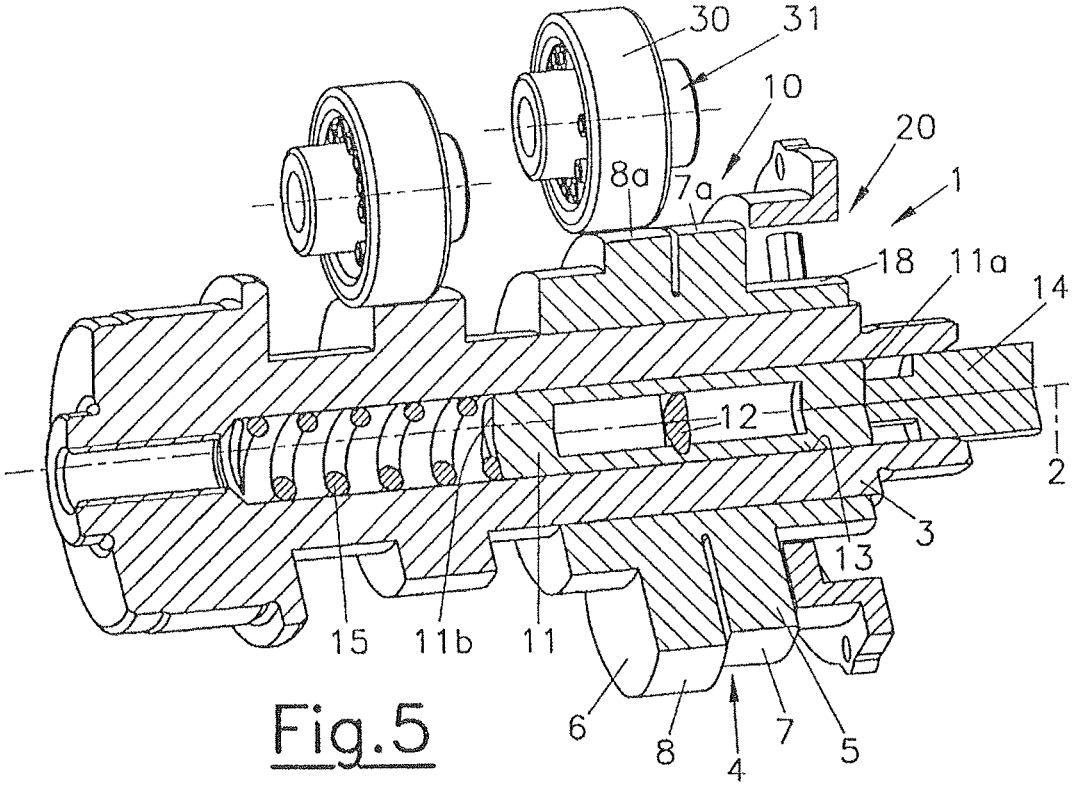
FIG. 5 shows the valve control device in a diagonal view in a longitudinal section in a second displacement position.
Figure 6:
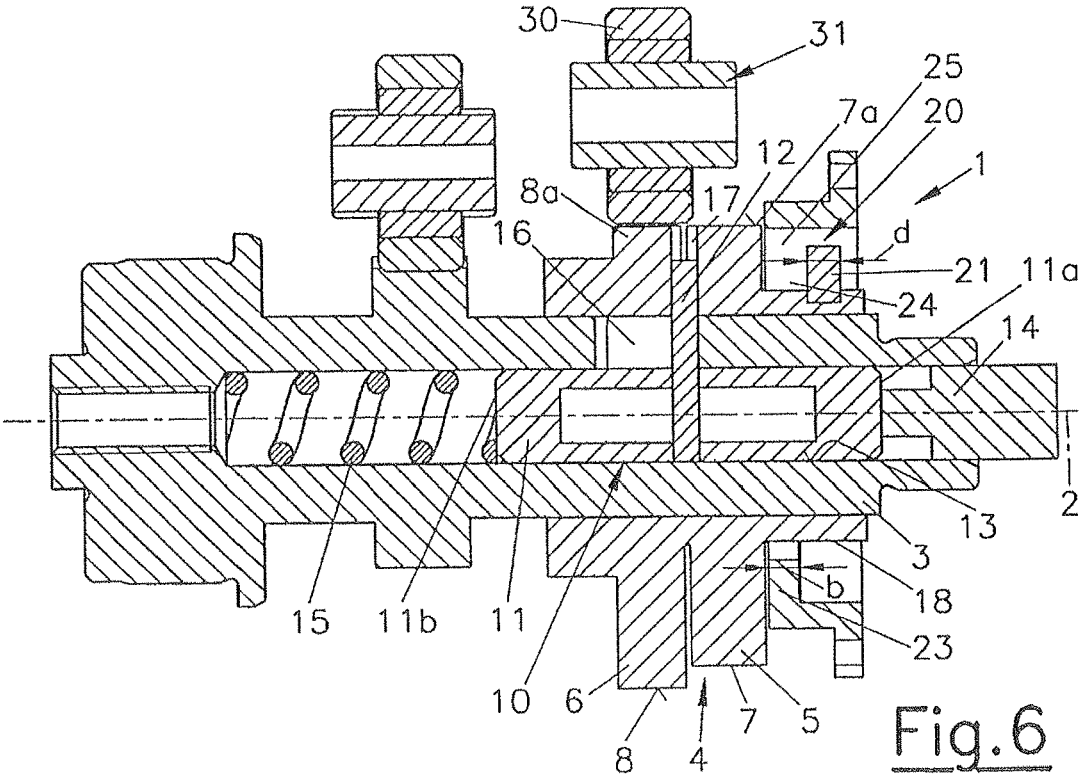
FIG. 6 shows the valve control device in a longitudinal section in the second displacement position.
Figure 7:
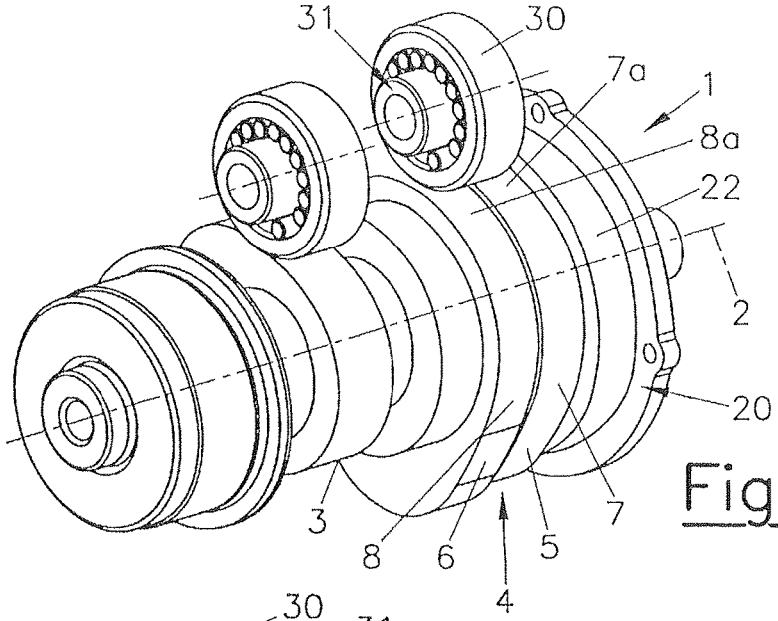
FIG. 7 shows the valve control device in another diagonal view in the second displacement position.
Figure 8:
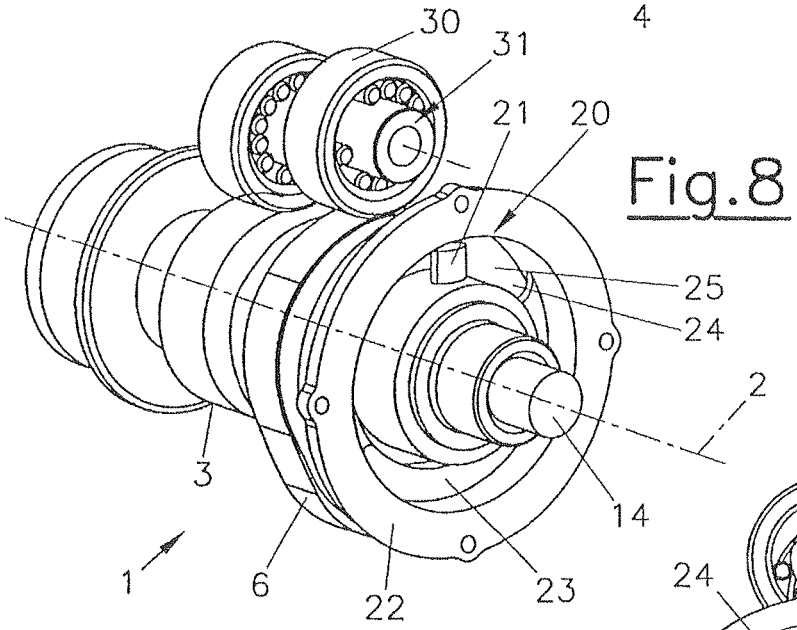
FIG. 8 shows the valve control device in a further diagonal view in the second displacement position.

In FIG. 5 and FIG. 6, the cam device 4 is located in a second displacement position, wherein the second cam 6 is activated using the second cam track 8. The positioning element 11 is pressed by the restoring spring 15 arranged inside the camshaft 3, with deactivated actuator 14, to the right in FIG. 5 and FIG. 6, i.e., in the direction of the locking element 20. In the illustrated location of the camshaft 3, the base circles 7*a*, 8*a* also face toward the transmission element 30 of the lift transmission device here. The control stud 21 is therefore located in the region of the control opening 25, such that the axial adjustment movement of cam device 4 is released by the locking element 20—corresponding to the activation of the actuator 14.

The cam device 4—still or already causing a valve lift of the corresponding gas exchange valve—is also still located in its second displacement position in FIG. 9, however, the adjustment movement of the cam device 4 by the actuator 14 into the first displacement position is blocked by the locking element 20, since the locking pin 21 is located outside the control opening 25 and therefore presses against the wall 23. The adjustment movement from the second into the first displacement position is only released when the control stud 21 is rotated by the camshaft 3 into an upper position seen in the figures and—observed in a projection in the direction of the camshaft axis 2—is located inside the control opening 25.

The locking element 20 enables a simple activation of the activator 14, since it can be activated or deactivated independently of the respective rotational position of the camshaft 3.

It should be clear that the invention is not limited to the described exemplary embodiment, but rather various modifications are possible within the scope of protection of the main claim. Other types of design embodiments are also conceivable.

The invention claimed is:

1. A variable valve control device for internal combustion engines of a reciprocating piston design, the variable valve control device comprising:

at least one gas exchange valve actuated by means of a camshaft rotatable about a camshaft axis;

a cam device connected to the camshaft in a rotationally-fixed and axially adjustable manner, the cam device having at least two different cam tracks, wherein alternately one cam track of the at least two different cam tracks is activated and at least one other cam track of the at least two different cam tracks is deactivated by means of a control device;

wherein the control device has at least one positioning element and at least one driver part, wherein the cam device is adjustable by means of the at least one positioning element and the at least one driver part;

wherein at least one locking element is provided for locking or releasing the axial adjustment of the cam device, the locking element having a control stud fixedly connected to the cam device and a control plate arranged coaxially to the camshaft; and wherein the control plate has at least one control opening in at least one angle range for accommodating the control stud.

2. The valve control device according to claim 1, wherein the control stud is arranged radially protruding on the cam device.

3. The valve control device according to claim 2, wherein the control stud is arranged in a region of a cylindrical outer casing of the cam device.

4. The valve control device according to claim 1, wherein the at least one control opening is arranged in a wall of the control plate facing toward the cam device.

5. The valve control device according to claim 4, wherein the wall is formed extending normal to the camshaft axis.

6. The valve control device according to claim 1, wherein the at least one control opening is formed as a wall breakthrough of a wall of the control plate.

7. The valve control device according to claim 1, wherein the at least one control opening is essentially shaped as a circular segment or circular ring segment.

8. The valve control device according to claim 1, wherein the at least one control opening extends over an angle range (β) of at least 60° about the camshaft axis.

9. The valve control device according to claim 8, wherein the at least one control opening extends over an angle range (β) of at least 90° about the camshaft axis.

10. The valve control device according to claim 1, wherein when measured along of the camshaft axis, a wall of the control plate has a thickness (b) essentially equal to a thickness (d) of the control stud.

11. The valve control device according to claim 1, wherein the control plate is exposed on opposing sides of a wall of the control plate.

12. The valve control device according to claim 1, wherein the at least one control opening and the control stud are arranged in relation to one another in the at least one angle range of the control plate such that the cam device is only adjustable in a valve-lift-free state.

13. The valve control device according to claim 12, wherein base circles of the at least two different cam tracks face toward a lift transmission device in the valve-lift-free state.

14. The valve control device according to claim 1, wherein said at least one positioning element is guided inside the camshaft.

15. The valve control device according to claim 1, wherein said at least one driver part extends radially from the at least one positioning element such that the cam device is axially adjustable by means of the at least one positioning element and the at least one driver part.

16. The valve control device according to claim 1, wherein the control plate is fixed.

* * * * *